US009145748B1

(12) United States Patent
Meier et al.

(10) Patent No.: US 9,145,748 B1
(45) Date of Patent: Sep. 29, 2015

(54) FLUID VELOCITY-DRIVEN CIRCULATION TOOL

(71) Applicant: C&J Energy Services, Inc., Houston, TX (US)

(72) Inventors: Kyle R. Meier, Katy, TX (US); Christopher R. Arnold, Sugar Land, TX (US)

(73) Assignee: C&J Energy Services, Inc., Houston, TX (US)

( * ) Notice: Subject to any disclaimer, the term of this patent is extended or adjusted under 35 U.S.C. 154(b) by 0 days.

(21) Appl. No.: 14/527,407

(22) Filed: Oct. 29, 2014

(51) Int. Cl.
*E21B 21/10* (2006.01)

(52) U.S. Cl.
CPC ..... *E21B 21/103* (2013.01)

(58) Field of Classification Search
CPC ..... E21B 21/103
See application file for complete search history.

(56) References Cited

U.S. PATENT DOCUMENTS 4,889,199 A 12/1989 Lee
5,890,540 A 4/1999 Pia et al.
6,095,249 A * 8/2000 McGarian et al. ..... 166/319
6,889,771 B1 5/2005 Leising et al.
7,357,198 B2 * 4/2008 Mcgarian et al. ..... 175/214
7,584,800 B2 9/2009 Heath et al.
7,766,084 B2 * 8/2010 Churchill ..... 166/320
7,766,086 B2 8/2010 Mondelli et al.
8,201,633 B2 6/2012 Hilliard

* cited by examiner

*Primary Examiner* — David Andrews
(74) *Attorney, Agent, or Firm* — McGlinchey Stafford, PLLC; R. Andrew Patty, II

(57) ABSTRACT

Apparatus for diverting fluid flow out of a working string, having a primary sub housing defining an axial bore and one or more primary sub housing circulation ports; a valve within the housing and defining one or more valve circulation ports. The valve ports are in fluid communication with the housing ports when the valve is in an open circulation position. One or more fluid-impinged surfaces are included and disposed within the primary sub housing and in operative connection with the valve. Fluid flowing through the primary sub housing impinges upon the fluid-impinged surfaces and, at a sufficient flow rate, causes the valve to move so as to actuate the valve in opposition to a biasing force operating on the valve and into open circulation position to cause flow of fluid out of the valve and primary sub housing through the aligned valve and primary housing ports.

21 Claims, 6 Drawing Sheets

FLUID VELOCITY-DRIVEN CIRCULATION TOOL

TECHNICAL FIELD

This invention pertains to the technical field of circulation tools for use in diverting fluid flow within a working string in subterranean drilling or milling operations, for example, in oil and gas exploration, and methods of their use.

THE INVENTION

During certain oil or gas well drilling operations such as, e.g., coiled tubing milling operations, it is essential the wellbore is cleared from debris produced through the milling process. The milling process may include plugs from multistage hydraulic fracturing operations, scale, sand, or other obstructions needing removal from the wellbore. If the wellbore is not cleaned thoroughly, there is an opportunity for the tubing to become stuck in the well, which can lead to increased operational cost.

A circulation sub attempts to improve the cleanout process through increased flow rate. Generally, the flow rates necessary for improving the cleanout process are too high for the drilling motor or downhole tractoring mechanism being used. Therefore, the circulation tool's main objective is to divert all or some of the fluid into the annulus so this fluid does not reach the tools downstream. Current circulation subs on the market are limited by how many times the tool can cycle, or are so lengthy they add operational cost. Another issue is the existing market's use of pressure differential activation in some circulating sub designs. This feature introduces the potential for any surges in pressure to either deactivate or activate the tool unpredictably. Since these tools generally have a multitude of pistons, seals, and springs, problems may arise if one or more seals are compromised. Also, in effect, the existing designs provide tools which are disadvantageously greater in length, due to the use of multiple, redundant parts. Some existing designs also rely on one or more annulus pressure sensing ports that have the possibility of becoming plugged.

A need thus continues to exist for a circulating sub which can provide efficient and effective circulation control, without introducing one or more of the aforesaid disadvantages present in previously conceived designs.

This invention addresses one or more of the foregoing problems or needs by providing, amongst other things, a downhole tool of particular, but not exclusive, utility in coiled tubing milling applications. In one aspect of the invention, the tool operates on the velocity of fluid flowing through the tool in order to open and close. Through changing the fluid velocity by adjusting the fluid flow rate at the surface, a fluid passage is opened while selectively regulating another fluid passage. Thus, the primary, if not the only, operational parameter required to shift the tool between an open circulation position and a closed circulation position is the pump rate at the surface.

Specifically, in one aspect of a tool of the invention, a circulating sub tool is equipped with one or more fluid-impinged surfaces operatively connected to or integral with a biased valve. The one or more fluid-impinged surfaces are generally disposed so as to intersect in a non-perpendicular, angular fashion with a vector indicative of the primary direction of fluid displacement through the tool, so that fluid flowing through the tool during its use will impinge upon the one or more surfaces so as to generate torque or other motive forces (e.g., linear forces). When the motive force reaches a sufficient, pre-determined level, the bias acting upon the valve is overcome, causing the biased valve to rotate and/or move in opposition to the bias. During such movement, at or above a sufficient fluid flow rate, the biased valve is urged to rotate and/or slide axially downstream so as to actuate the valve. When so actuated, the valve defines a fluid flow path sufficient to permit fluid to flow through the valve and out of the tool through the tool's primary housing, so that at least some of the fluid flows out of the tool when the valve is actuated. Below the minimum flow rate, the diminution in motive force acting upon the biased valve will permit bias acting upon the valve to urge the valve back into a closed position, whereby the valve is closed to at least partially inhibit the flow of fluid through the valve. Thus, in this aspect of the invention, the tool comprises:

a primary sub housing defining an axial bore therethrough and defining one or more primary sub housing circulation ports through a primary sub housing sidewall;

a biased valve disposed within the primary sub housing axial bore, the valve defining one or more valve circulation ports, the valve circulation ports each being sized and configured to be in fluid communication with at least one of the primary sub housing circulation ports when the valve is in an open circulation position; and one or more fluid-impinged surfaces integral with or operatively connected to the biased valve and being disposed within the primary sub housing axial bore;

whereby fluid flowing through the axial bore of the primary sub housing impinges upon the fluid-impinged surfaces and, at a sufficient fluid flow rate, generates motive force in and movement of the valve in opposition to its bias and into the open circulation position, thereby permitting the flow of the fluid out of the valve and the primary sub housing through the valve circulation ports and the primary sub housing circulation ports.

The biased valve may take a variety of forms which slide axially or rotate, or both, during valve actuation within the tool. In one particular aspect of the invention, the valve comprises a sleeve substantially concentrically disposed with the primary sub housing axial bore, the sleeve defining a fluid pathway in fluid communication with the axial bore of the primary sub housing, wherein the valve circulation ports are sleeve circulation ports extending through a sleeve sidewall so that one or more of the sleeve circulation ports at least partially aligns with a respective one of the primary sub housing ports when the sleeve is in the open circulation position.

In another aspect of the invention, the tool further comprising an adapter operatively connected to the biased valve, wherein the fluid-impinged surfaces are formed by one or more turbine-like blades radially extending from, and either connected to or integral with, the adapter. The turbine-like blades extend axially in helical fashion along the outer surface of the adapter. In one particular aspect of the invention, the adapter is in the form of a cylindrical segment sized and configured for threadable attachment to the valve.

In yet another aspect of the invention, the tool further comprising a fluid restrictor disposed within the axial bore of the primary sub housing and downstream from the valve, the fluid restrictor being sized and configured to engage with a downstream primary opening of the tool when the valve is in an open circulation position, thereby inhibiting the flow of fluid through the downstream primary opening of the tool. In this way, fluid is further encouraged to flow out of the primary housing of the tool through the aligning or partially aligning valve and primary sub housing ports, rather than out of the tool through the downstream primary opening of the tool.

It should be understood that the "fluid flow rate" becomes sufficient to overcome the bias of the valve at a rate which can vary and is not a fixed value or range of values across the various aspects and applications of the invention. Rather, the fluid flow rate will depend upon a particular tool's geometrical configurations, the materials of construction used to form the tool and the operating conditions to which the tool is exposed, such as, e.g., the consistency and other physical properties of the fluid flowing through the string. While fluid flow rate will influence valve actuation, it will be noted that the tool is configured so that differences between fluid pressure within the tool and fluid pressure outside of the tool alone will not move the biased valve, and therefore will not actuate the biased valve. Rather, changes in the rate at which fluid flows through the tool will permit operators of the tool to control valve actuation so as to place the valve into a desired opened or closed circulation position.

Another aspect of the invention provides a method for controllably diverting fluid flow out of a working string. The method comprises:

pumping a fluid at a controllable flow rate into a downhole device connected to and in fluid communication with the working string, the downhole device defining one or more primary sub housing circulation ports for diverting fluid out of the downhole device and out of the working string when the downhole device is in an open circulation position, the downhole device comprising:

a biased valve disposed within the primary sub housing axial bore, the valve defining one or more valve circulation ports, the valve circulation ports each being sized and configured to be in fluid communication with at least one of the primary sub housing circulation ports when the valve is in an open circulation position, and one or more fluid-impinged surfaces integral with or operatively connected to the biased valve and being disposed within the primary sub housing axial bore, whereby fluid flowing through the axial bore of the primary sub housing impinges upon the fluid-impinged surfaces and, at or above a pre-determined fluid flow rate, generates motive force in and movement of the valve in opposition to its bias and into the open circulation position; and raising the controllable flow rate of the fluid flowing through the downhole device to be at or above the pre-determined fluid flow rate, so as to move the biased valve into an open circulation position, thereby diverting the fluid through the circulating ports and out of the working string. In a particular aspect of the invention, the method is carried out independently of any pressure differential between fluid inside and fluid outside of the tool. In this aspect, the method is thus carried out without requiring production of tool-actuating pressure differential in order to initiate or terminate circulation of fluid.

These and other features, advantages and aspects of the invention shall become even more apparent from the ensuing detailed description, appended claims and accompanying drawings.

BRIEF DESCRIPTION OF THE DRAWINGS

Like numerical or letter references found in the figures refer to like parts or components illustrated within the several figures.

FURTHER DETAILED DESCRIPTION OF THE INVENTION

The particular illustrative examples which are described with particularity in this specification are not intended to limit the scope of the invention. Rather, the examples are intended as concrete illustrations of various features and advantages of the invention, and should not be construed as an exhaustive compilation of each and every possible permutation or combination of materials, components, configurations or steps one might contemplate, having the benefit of this disclosure. Similarly, in the interest of clarity, not all features of an actual implementation of a tool or related methods of use are described in this specification. It of course will be appreciated that in the development of such an actual implementation, numerous implementation-specific decisions must be made to achieve the developers' specific goals, such as compliance with system-related and economic-related constraints, which may vary from one implementation to another. Moreover, it will be appreciated that while such a development effort might be complex and time-consuming, it would nevertheless be a routine undertaking for those of ordinary skill in the art having the benefit of this disclosure.

Figure 1A:
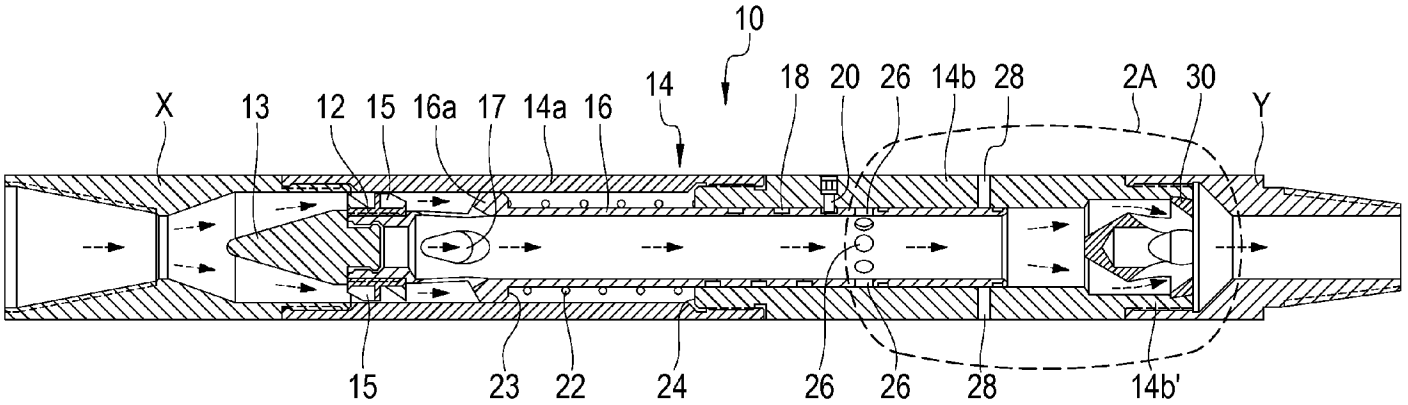
FIG. 1A is a side cross-sectional view of a tool in accordance with one aspect of this invention, in a closed position.

One particular, illustrative aspect of the invention is shown in FIGS. 1A through 4C. FIGS. 1A and 1B show a circulating sub 10 in cross-section, while it is threadably received between working string components X and Y. Circulating sub 10 includes an adapter comprising one or more fluid-impinged surfaces, the adapter being in the illustrated form of a turbine style rotor 12 disposed axially and concentrically in a cylindrical primary sub housing 14 defining an axial bore therethrough and formed by threadably engaged, cylindrical housing segments 14*a* and 14*b*. Rotor 12 axially abuts a biased valve illustrated in the form of a main shifting sleeve 16 and is held in place by threaded coupling to an upstream end of sleeve 16 and is disposed just downstream from a nose cone 13 mated to the upstream end of sleeve 16. The outer surface of sleeve 16 forms at least one helical groove 18 that is sized to mate with a pin 20 disposed in and extending through the cylindrical wall of housing segment 14*b*. A coil compression spring 22 is disposed around sleeve 16 so that spring 22 shoulders upon a step 23 formed by an upstream shoulder portion 16*a* of sleeve 16 and on an upper face 24 of cylindrical housing segment 14*b*.

As fluid (see vector arrows indicating a general direction of fluid displacement) flows in a downstream direction through the working string and through sub 10, the fluid passes around cone 13 and impinges upon a plurality of helical turbine blades 15 of rotor 12, thereby developing rotational and linear forces on rotor 12 which are transferred to sleeve 16 through contact between a downstream face 12' of rotor 12 and an upstream face 16' of sleeve 16. Fluid also passes into sleeve 16 through sleeve passages 17. When the fluid flow rate is such that the downstream linear force placed upon sleeve 16 exceeds the upstream biasing force of spring 22 and any frictional force present as the result of any contact between pin 20 and sleeve 16 at helical groove 18, sleeve 16 will slide downstream. As the flow rate increases, the force increases and also rotates sleeve 16 through the interaction between pin 20 and helical groove 18. The amount of axial displacement of sleeve 16 along the central longitudinal axis of primary sub housing 14 may be predetermined by spring (or other biasing means) selection, rotor blade geometry, or groove geometry, for example. As sleeve 16 displaces along the longitudinal axis of main cylindrical housing 14, ports 26 extending through a portion of the cylindrical wall of sleeve 16 and ports 28 extending through the a portion of the cylindrical wall of main sub housing 14 come into alignment, allowing fluid communication between the tool's tubing bore and the annulus or other space surrounding the circulating sub tool. A flow-restrictor in the form of a cone 30 defines one or more flow pathways 31 and is connected to or integral with a downstream end 14*b'* of housing segment 14*b*, to create either a partial or a complete blockage in the flow path downstream when sleeve 16 has shifted a sufficient distance downstream so as to engage with cone 30 (as see in FIGS. 1B and 2B). When so engaged, fluid is inhibited from flowing out of the downstream end of sleeve 16 and through pathways 31, but instead will exit out of the now aligned ports 26 and 28, when the flow rate is at or above the predetermined flow rate. It may be desirable in certain alternative aspects of the invention to configure the cone 30 to permit some fluid to still flow out of sleeve 16 while cone 30 is engaged therewith, so that cone 30 either only partial engages with sleeve 16 when sleeve 16 is in an open circulation position, or either or both of cone 30 and/or sleeve 16 are configured to form one or more restricted fluid pathways to permit some fluid to flow through or around cone 30 even during its engagement with sleeve 16.

In some aspects of the invention, the tool further comprises biasing means for biasing the valve toward a closed circulation position in which none of the valve circulation ports are aligned with any of the primary sub housing circulation ports. The biasing means of the invention can vary depending upon the structural and functional needs of a given application. Thus, while the illustrated biasing means in the figures is a compression spring, other biasing means are easily contemplated by those of skill in the art having the benefit of this disclosure, and may include, for example, Belleville washers, a helical spring, torsional spring, a machine or gas spring, and the like. Biasing means in the form of a torsional spring, are illustrated and further described below in connection with the device illustrated in FIGS. 6A and 6B.

Likewise, the predetermined flow rate at or above which an open position is achieved during operation of the circulating sub of this invention can vary widely, and will depend upon, for example, the fluid flowing through the tool, the geometries of the components of the tool and the string, and the like. Flow rates are said to be controllable in the sense that the rate may be selectively raised or lowered as needed under a given circumstance, recognizing that the rate may at times vary from a desired flow level due to the conditions of use of the system, but in general may be adjusted by a user of the system with which the tool is engaged during normal operations. Non-limiting examples of flow rates typically employed in systems such as those illustrated by way of example in this disclosure would fall in the range of about two barrels per minute to about six barrels per minute, but again, could vary even outside of this range depending upon the variable conditions, including for example, the characteristics of the fluid, the environment and the tool configuration, as noted above. As will be appreciated by those of ordinary skill in the art with the benefit of this disclosure, these and other parameters which may influence the tool's performance can be engineered with the use of routine experimentation and/or computer simulation, to achieve the desired actuation at sufficient flow rates achievable by using the pumping equipment available to the user and acting on the fluid at hand. For example, it is conceivable that a detent or like mechanism could be employed to maintain the valve or sleeve in an open circulation position, until the fluid flow rate drops below a certain level. Alternatively or in addition, a j-slot groove configuration could be employed on the outer surface of a sleeve of the invention, for example, to provide greater control over the degree of circulation and opening or closing of the valve/sleeve at different flow rates. Just a j-slot configuration would enable placement of the valve/sleeve into one or more intermediate positions between completely opened and completely closed positions.

The fluid-impinged surface of the invention as illustrated are formed from helical, turbine-style blades extending from the adapter, but it will be appreciated by those of skill in the art from this disclosure that the fluid-impinged surfaces may be formed from other structures directly indirectly connected to, or integral with, the biased valve of this invention. Thus, for example, the fluid-impinged surfaces could be formed by a flat plate through which the fluid would flow out of directional nozzles, or helical channels cut into a solid rotor, etc. Preferentially, the fluid-impinged surfaces occupy one or more planes which intersect with the general vector of fluid disposition through the tool, so that torque or other motive force generated by fluid impingement upon the surfaces is transferred, directly or indirectly, to act upon the biased valve of the tool.

Figure 1B:
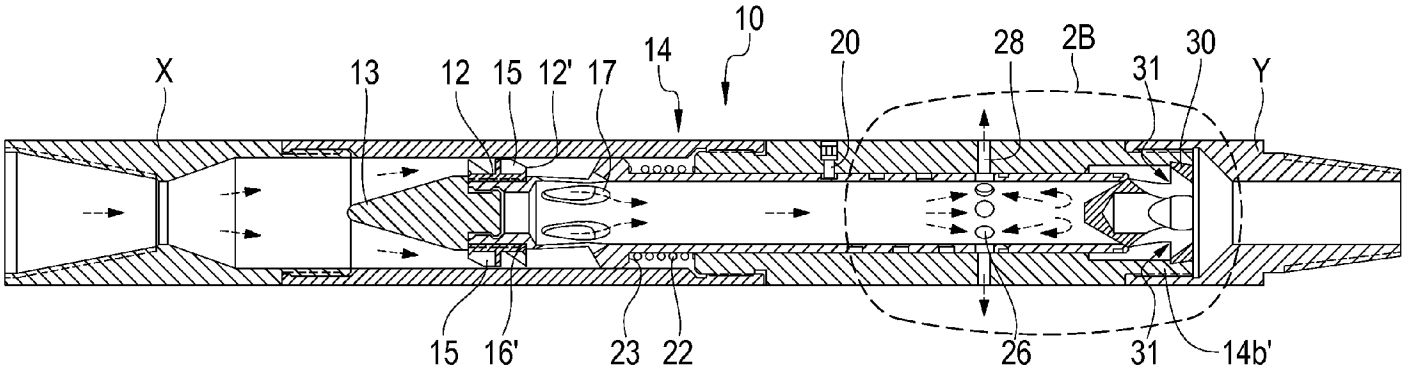
FIG. 1B is a side cross-sectional view of the tool of FIG. 1, in an opened position.
Figure 2A:
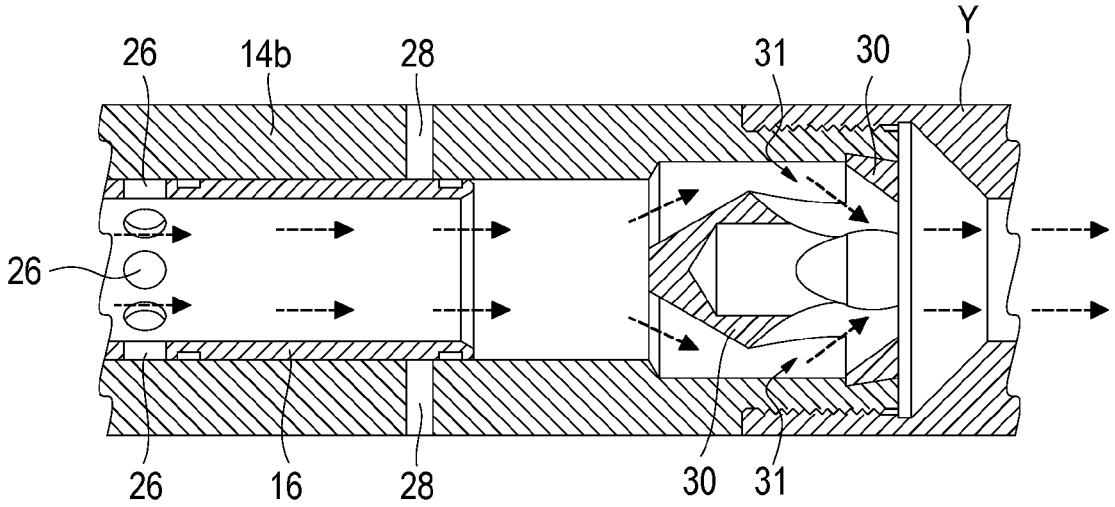
FIG. 2A is an enlarged view of the area "2A" identified in FIG. 1A.
Figure 2B:
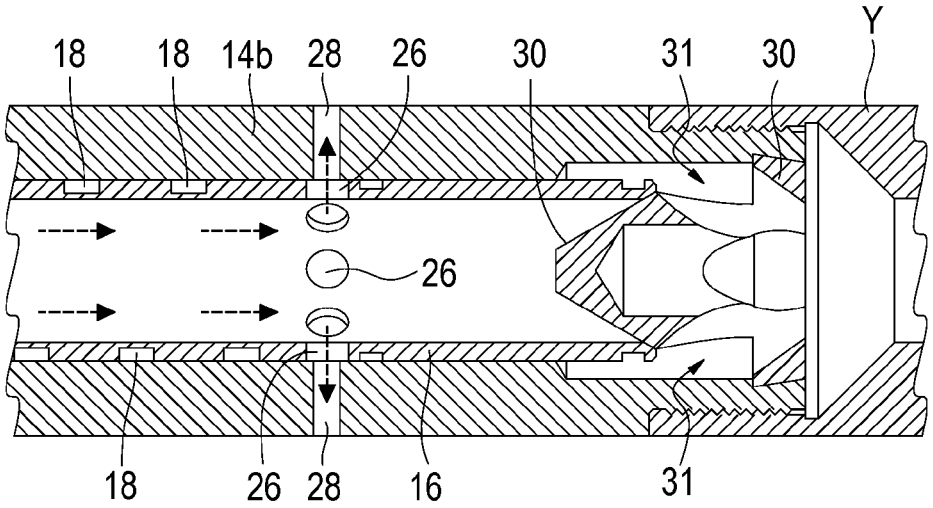
FIG. 2B is an enlarged view of the area "2B" identified in FIG. 1B.
Figure 3A:
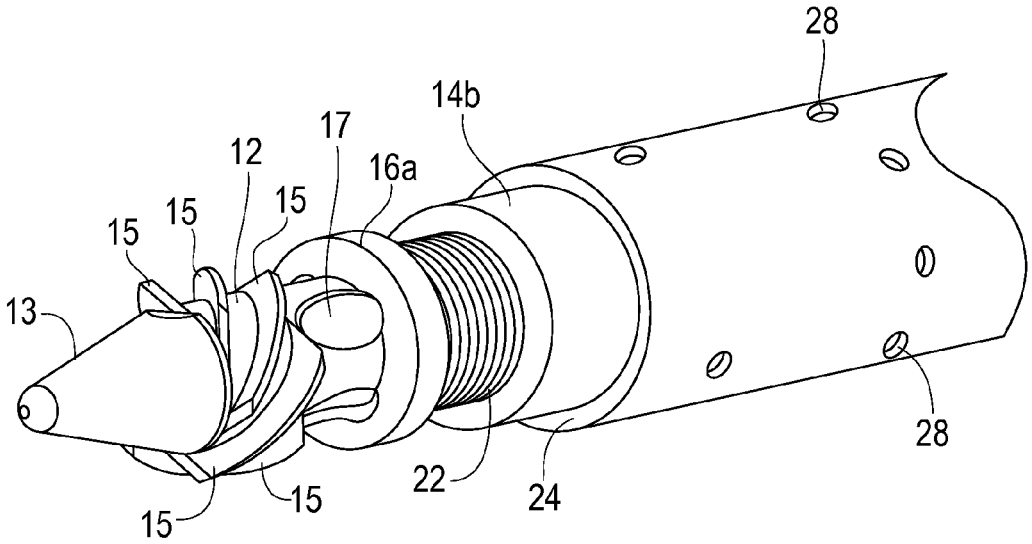
FIG. 3A is an elevated view in perspective of components of the device of FIG. 1.
Figure 3B:
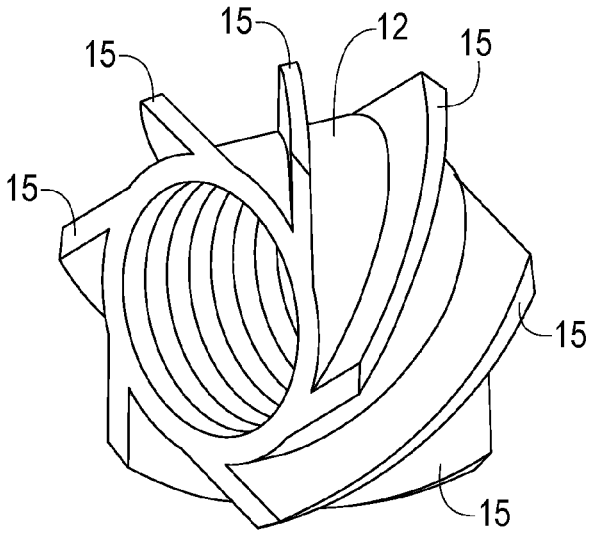
FIG. 3B is an elevated view in perspective of the turbine adapter component of the device of FIG. 1.
Figure 4A:
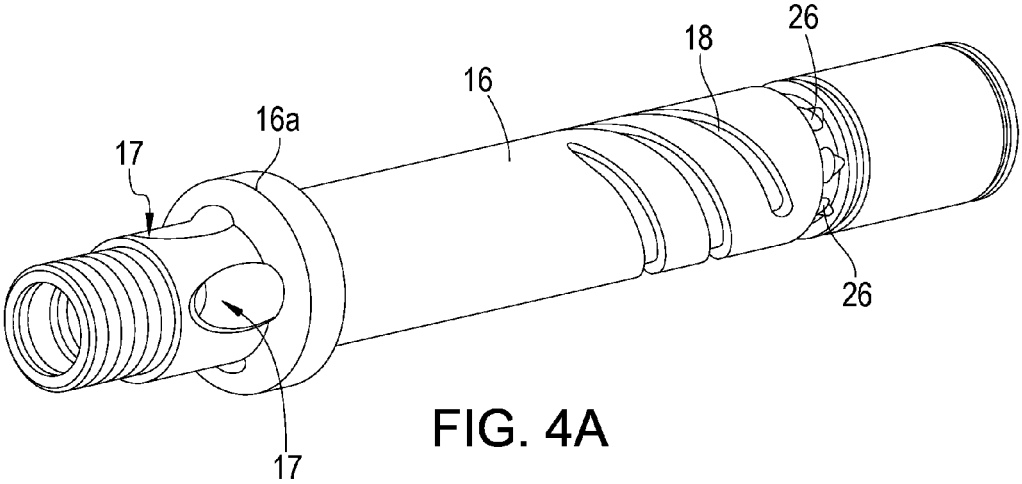
FIG. 4A is an elevated view in perspective of the circulation port-defining sleeve of the device of FIG. 1.
Figure 4B:
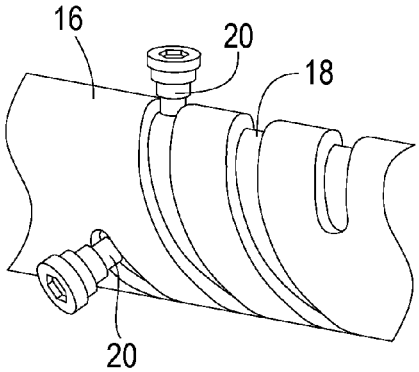
FIG. 4B is another perspective view of pins within the helical groove of the sleeve of FIG. 4A, broken away.
Figure 4C:
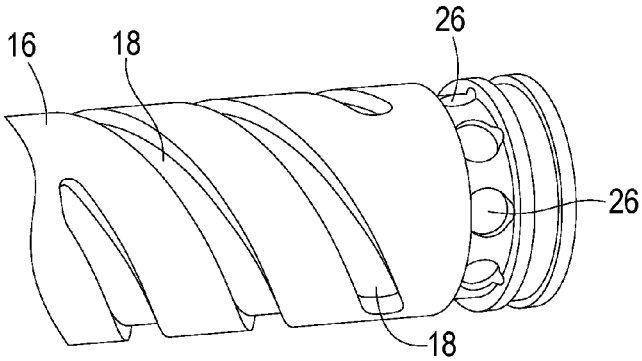
FIG. 4C is another perspective view of the circulation ports and helical groove of the sleeve FIG. 4A, partially broken away.

As can now be appreciated from the above description and accompanying figures, the invention also provides a method for controllably diverting fluid flow out of a working string. The method involves at least pumping a fluid at a variable flow rate into a downhole device 10 connected to and in fluid communication with the working string. The downhole device 10 defines one or more circulating ports 28 for diverting fluid out of the downhole device 10 and out of the working string when the downhole device 10 is in an open circulation position (as seen in FIGS. 1B and 2B). The downhole device 10 comprising an adapter comprising one or more fluid-impinged surfaces, in the illustrated form of turbine rotor 12 which under appropriate flow rate conditions transfers torque to and moves a biased sleeve 16 within the downhole device 10 into an open circulating position (shown in FIGS. 1B and 2B) when flowing fluid impinges upon the impingement surfaces, namely helical blades 15 of turbine rotor 12, and the flow rate is sufficient to overcome the bias acting upon sleeve 16 via a compression spring 22 and actuate rotor 12 to move sleeve 16 and align ports 26 and 28 with one another, and concurrently restrict the flow of fluid through the downstream opening of sleeve 16 via flow-restricting cone 30 when sleeve 16 is forced into the open circulation position. Of course, other partial or complete flow restrictors could be used in substitution of the cone depicted, as long as the flow restrictor employed is actuated into a flow-restricting position to inhibit the flow of fluid out of the downstream opening of the tool when the sleeve is urged towards an open circulation position, so that fluid is encouraged to circulate out of the tool through the sleeve. In this way, fluid may flow out of sleeve 16 and through the circulating ports 28 of downhole device 10. The method further involves raising the flow rate of the fluid flowing through the downhole device, for example, by raising the rate of fluid pumping at the surface, so as to actuate turbine rotor 12 to move the biased sleeve 16 into an open circulation position, thereby diverting the fluid through the aligned, circulating ports 26 and 28 out of the working string and into the annulus or other space surrounding device 10. To close the circulation, the pumping rate of the pump at surface can be lowered to thereby lower the flow rate of the fluid flowing through the downhole device 10 until the bias acting upon the biased sleeve 16 overcomes force of the turbine rotor 12 acting upon the biased sleeve 16, thereby moving sleeve 16 into a closed circulation position as shown in FIGS. 1A and 2A.

Figure 5:
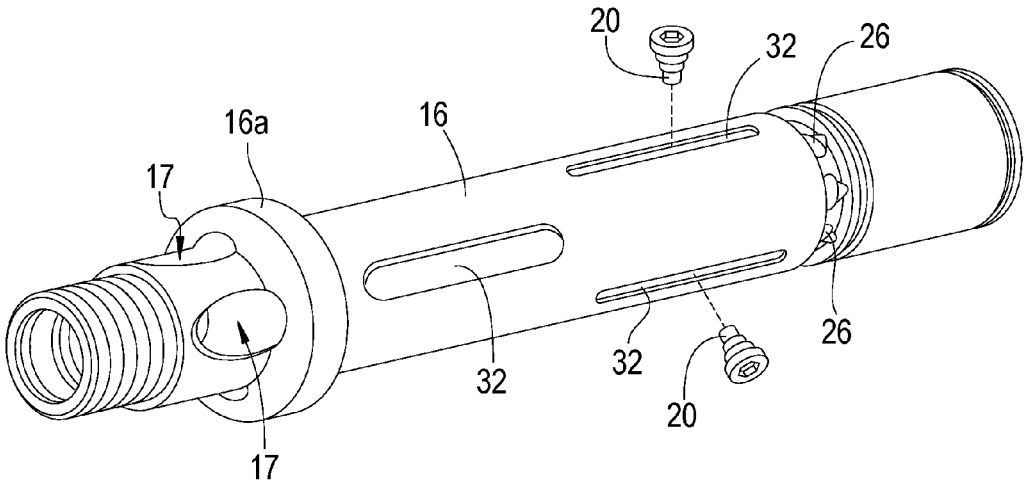
FIG. 5 is an elevated view in perspective of a circulation port-defining sleeve of an alternative aspect of this invention, where the sleeve forms multiple linear grooves and is shown with mating pins suspended radially outwardly from their respective linear grooves.

As is shown in FIG. 5, an alternative aspect of the invention provides a different groove geometry at the outer surface of sleeve 16, so that it forms one or more linear grooves 32 sized receiving respective pins 20. In this way, sleeve 16 does not necessarily rotate during its actuation into a closed or opened position during threshold changes in the fluid flow rate. This can, in some applications, facilitate movement of sleeve 16 during flow rate changes, if it is desirable that a lower minimum flow rate be sufficient to overcome the bias provided by the biasing means employed.

Figure 6A:
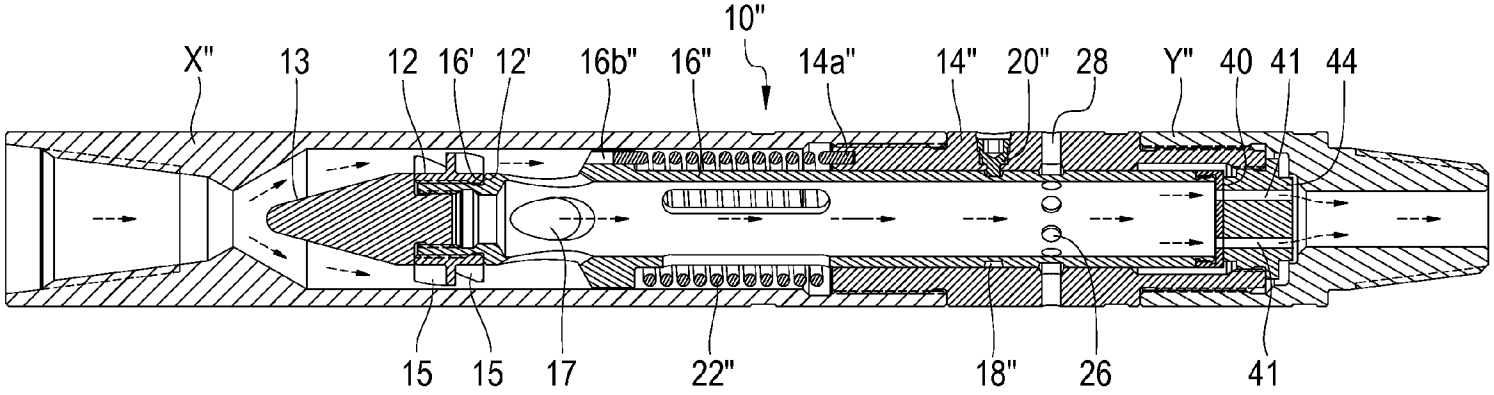
FIG. 6A is a side cross-sectional view of a tool in accordance with another aspect of this invention, in a closed position.
Figure 6B:
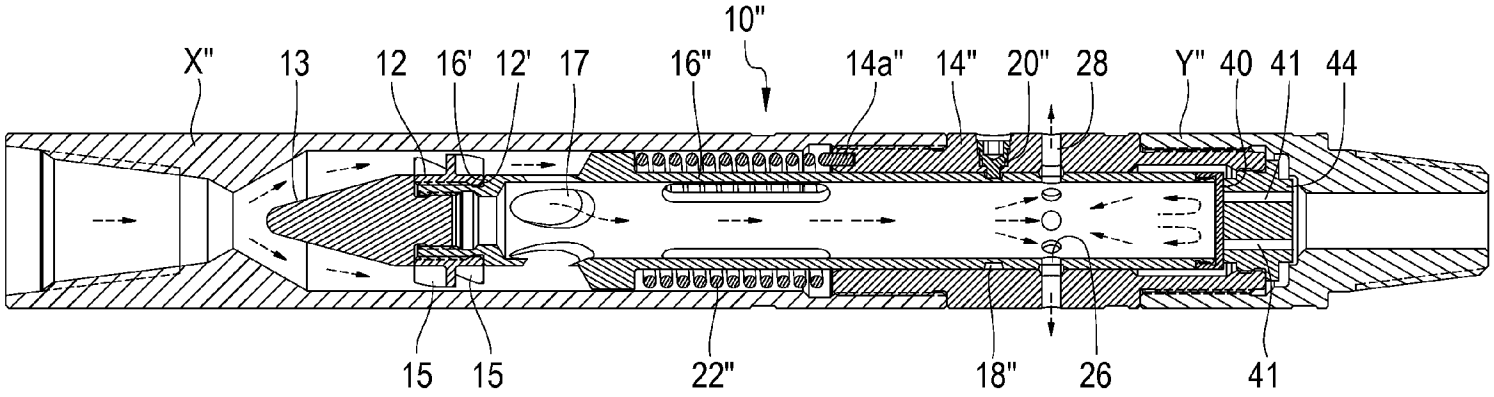
FIG. 6B is a side cross-sectional view of the tool of FIG. 6A, in an opened position.

In another aspect of the invention, the sleeve component of this invention is configured to rotate, but is not necessarily axially displaced, during actuation between an open and a closed circulation position, and vice versa. FIGS. 6A and 6B illustrate an example of this particular aspect of the invention. There, a circulating sub 10" is shown in cross-section, while it is threadably received between working string components X" and Y". Circulating sub 10" includes an adapter comprising one or more fluid-impinged surfaces, the adapter being in the illustrated form of a turbine style rotor 12 disposed axially and concentrically in a cylindrical portion of component X" defining an axial bore therethrough. Rotor 12 axially abuts a biased valve illustrated in the form of a main shifting sleeve 16" and is held in place by threaded coupling to an upstream end of sleeve 16" and is disposed just downstream from a nose cone 13 mated to the upstream end of sleeve 16". The outer surface of sleeve 16" forms at least one circumferential groove 18" that is sized to mate with a pin 20" disposed in and extending through the cylindrical wall of housing 14". A coiled torsion spring 22" is disposed around sleeve 16" so that spring 22" is coupled to sleeve 16" at an upstream end by insertion into a bore 16*b*" defined by sleeve 16" and coupled to housing 14" at a downstream end by insertion into an bore 14*a*" defined by housing 14".

As fluid (see vector arrows indicating a general direction of fluid displacement) flows in a downstream direction through the working string and through sub 10", the fluid passes around cone 13 and impinges upon a plurality of helical turbine blades 15 of rotor 12, thereby developing rotational forces on rotor 12 which are transferred to sleeve 16" through the threaded coupling between rotor 12 and sleeve 16" and any contact between a downstream face 12' of rotor 12 and an upstream face 16' of sleeve 16". Fluid also passes into sleeve 16" through sleeve passages 17. When the fluid flow rate is such that the rotational force placed upon sleeve 16" exceeds the opposing torsional biasing force of spring 22" and any frictional force present as the result of any contact between pin 20" and sleeve 16" at circumferential groove 18", sleeve 16" will rotate. As the flow rate increases, the rotational force increases and further rotates sleeve 16". The amount of rotational displacement of sleeve 16" about the central longitudinal axis of primary sub housing 14" may be predetermined by torsional spring (or other biasing means) selection, rotor blade geometry, or groove geometry, for example. As sleeve 16" displaces rotationally around the longitudinal axis of main cylindrical housing 14", ports 26 extending through a portion of the cylindrical wall of sleeve 16" and ports 28 extending through the a portion of the cylindrical wall of main sub housing 14" come into alignment, allowing fluid communication between the tool's tubing bore and the annulus or other space surrounding the circulating sub tool. A flow-restrictor also is provided to restrict flow out of sleeve 16" when the sleeve 16" is in an open circulation position. The flow restrictor is in the form of an end cap 40 threadably connected to or integral with the downstream end of sleeve 16" and a downstream, adjacent end block 44 threadably connected to or integral with housing 14". Cap 40 and block 44 together define one or more flow pathways 41, 41 when sufficiently aligned as shown in FIG. 6A. When cap 40 and block 44 are not aligned so that their respective portions of pathways 41,41 do not allow fluid flow therethrough, end cap 40 effectively blocks the flow of fluid out of sleeve 16" so as to encourage fluid to flow instead out of the aligned or partially aligned ports 26 and 28. In this way, cap 40 and block 44 create either a partial or a complete blockage in the flow path downstream when sleeve 16" has rotated about the longitudinal center axis a sufficient distance so as to block the flow of fluid through pathways 41,41. When so blocked, fluid is inhibited from flowing out of the downstream end of sleeve 16"b (as seen in FIG. 6B), and instead will exit out of aligned or partially aligned ports 26 and 28, when the flow rate is at or above the predetermined flow rate so that sleeve 16" is sufficiently rotated to provide for such port alignment and cap-block misalignment. It may be desirable in certain alternative aspects of the invention to configured cap 40 and block 44 and the flow pathways they form to permit some fluid to still flow out of sleeve 16" while pathways 41,41 are at least partially blocked or misaligned.

While dimensions are not necessarily a limitation upon the invention, the typical dimensions of the tools used in downhole applications will have an overall average diameter in the range of 1.6875" to 3.125", although other dimensions are conceivable and could suffice under some circumstances, as one of skill in the art can appreciate given the benefit of this disclosure. Generally speaking, the overall tool string length can vary widely, but typically should be short enough so that the tool string will fit within the riser.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise. Furthermore, aspects of the invention may comprise, consistent essentially of, or consist of the indicated elements or method steps.

This invention is susceptible to considerable variation within the spirit and scope of the appended claims.

The invention claimed is:

1. An apparatus for diverting fluid flow out of a working string, the apparatus comprising:

a primary sub housing defining an axial bore therethrough and defining one or more primary sub housing circulation ports through a primary sub housing sidewall;

a biased valve disposed within the primary sub housing axial bore, the valve defining one or more valve circulation ports, the valve circulation ports each being sized and configured to be in fluid communication with at least one of the primary sub housing circulation ports when the valve is in an open circulation position;

one or more fluid-impinged surfaces integral with or operatively connected to the biased valve and being disposed within the primary sub housing axial bore, whereby fluid flowing through the axial bore of the primary sub housing impinges upon the fluid-impinged surfaces and, at a sufficient fluid flow rate, generates motive force in and movement of the valve in opposition to its bias and into the open circulation position, thereby permitting the flow of the fluid out of the valve and the primary sub housing through the valve circulation ports and the primary sub housing circulation ports, wherein the biased valve is biased independently of any pressure differential between fluid inside and fluid outside of the apparatus, and wherein during operation of the apparatus the fluid flows through a restricted flow path which is defined at least in part by the fluid-impinged surfaces and has a minimum cross-sectional area that remains unchanged while the valve is moved into and out of the open circulation position.

2. The apparatus of claim 1, wherein the valve comprises a sleeve substantially concentrically disposed with the primary sub housing axial bore, the sleeve defining a fluid pathway in fluid communication with the axial bore of the primary sub housing, wherein the valve circulation ports are sleeve circulation ports extending through a sleeve sidewall so that one or more of the sleeve circulation ports at least partially aligns with a respective one of the primary sub housing ports when the sleeve is in the open circulation position.

3. The apparatus according to claim 2, further comprising an adapter operatively connected to the biased valve, wherein the fluid-impinged surfaces are formed by one or more turbine-like blades radially extending from, and either connected to or integral with, the adapter.

4. The apparatus according to claim 3 further comprising biasing means for biasing the sleeve toward a closed circulation position in which none of the sleeve circulation ports are aligned with any of the primary sub housing circulation ports.

5. The apparatus of claim 2, wherein the sleeve forms a groove on its outer surface, engaging one or more pins extending from an inner sidewall surface of the primary sub housing.

6. The apparatus of claim 5, wherein the groove is axially extending and is helical.

7. The apparatus of claim 6, further comprising a fluid restrictor disposed within the axial bore of the primary sub housing and downstream from the sleeve, the fluid restrictor being sized and configured to engage with a downstream primary opening of the sleeve when the sleeve is in an open circulation position, thereby inhibiting the flow of fluid through the downstream primary opening of the sleeve.

8. The apparatus of claim 2, further comprising a fluid restrictor disposed within the axial bore of the primary sub housing and downstream from the sleeve, the fluid restrictor being sized and configured to engage with a downstream primary opening of the sleeve when the sleeve is in an open circulation position, thereby inhibiting the flow of fluid through the downstream primary opening of the sleeve.

9. The apparatus according to claim 1, further comprising an adapter operatively connected to the biased valve, wherein the fluid-impinged surfaces are formed by one or more turbine-like blades radially extending from, and either connected to or integral with, the adapter.

10. The apparatus according to claim 1 further comprising biasing means for biasing the valve toward a closed circulation position in which none of the valve circulation ports are aligned with any of the primary sub housing circulation ports.

11. The apparatus of claim 1, further comprising a fluid restrictor disposed within the axial bore of the primary sub housing and downstream from the valve, the fluid restrictor being sized and configured to engage with a downstream primary opening of the tool when the valve is in an open circulation position, thereby inhibiting the flow of fluid through the downstream primary opening of the tool.

12. A method for controllably diverting fluid flow out of a working string, the method comprising:

pumping a fluid at a controllable flow rate into a downhole device connected to and in fluid communication with the working string, the downhole device defining one or more primary sub housing circulation ports for diverting fluid out of the downhole device and out of the working string when the downhole device is in an open circulation position, the downhole device comprising:

a biased valve disposed within a primary sub housing axial bore, the valve defining one or more valve circulation ports, the valve circulation ports each being sized and configured to be in fluid communication with at least one of the primary sub housing circulation ports when the valve is in an open circulation position, and one or more fluid-impinged surfaces integral with or operatively connected to the biased valve and being disposed within the primary sub housing axial bore, whereby fluid flowing through the axial bore of the primary sub housing impinges upon the fluid-impinged surfaces and, at or above a predetermined fluid flow rate, generates a motive force acting upon the valve in opposition to its bias and into the open circulation position; and raising the controllable flow rate of the fluid flowing through the downhole device to be at or above the predetermined fluid flow rate, so as to move the biased valve into an open circulation position, thereby diverting the fluid through the circulating ports and out of the working string, wherein the biased valve is biased independently of any pressure differential between fluid inside and fluid outside of the tool, and wherein during operation of the device the fluid flows through a restricted flow path which is defined at least in part by the fluid-impinged surfaces and has a minimum cross-sectional area that remains unchanged while the valve is moved into and out of the open circulation position.

13. The method of claim 12, wherein the valve comprises a sleeve substantially concentrically disposed with the primary sub housing axial bore, the sleeve defining a fluid pathway in fluid communication with the axial bore of the primary sub housing, wherein the valve circulation ports are sleeve circulation ports extending through a sleeve sidewall so that one or more of the sleeve circulation ports at least partially aligns with a respective one of the primary sub housing ports when the sleeve is in the open circulation position.

14. The method of claim 12, wherein the downhole device further comprises a fluid restrictor disposed within the axial bore of the primary sub housing and downstream from the valve, and wherein the fluid restrictor engages with a downstream primary opening of the tool when the valve is in an open circulation position, thereby inhibiting the flow of fluid through the downstream primary opening of the tool.

15. The method of claim 14, further comprising lowering the flow rate of the fluid flowing through the downhole device until the bias acting upon the biased sleeve overcomes the motive force acting upon the biased sleeve, thereby moving the sleeve into a closed circulation position and disengaging the fluid restrictor from the downstream primary opening of the tool.

16. The method of claim 12, further comprising lowering the flow rate of the fluid flowing through the downhole device until the bias acting upon the biased sleeve overcomes the motive force acting upon the biased sleeve, thereby moving the sleeve into a closed circulation position.

17. The method of claim 12, wherein the valve comprises a sleeve substantially concentrically disposed with the primary sub housing axial bore, the sleeve defining a fluid pathway in fluid communication with the axial bore of the primary sub housing, wherein the valve circulation ports are sleeve circulation ports extending through a sleeve sidewall so that one or more of the sleeve circulation ports at least partially aligns with a respective one of the primary sub housing ports when the sleeve is in the open circulation position.

18. An apparatus for diverting fluid flow out of a working string, the apparatus comprising:

a primary sub housing defining an axial bore therethrough and defining one or more primary sub housing circulation ports through a primary sub housing sidewall;

a biased valve disposed within the primary sub housing axial bore, the valve defining one or more valve circulation ports, the valve circulation ports each being sized and configured to be in fluid communication with at least one of the primary sub housing circulation ports when the valve is in an open circulation position;

biasing means for biasing the valve toward a closed circulation position in which none of the valve circulation ports are aligned with any of the primary sub housing circulation ports, and one or more fluid-impinged surfaces integral with or operatively connected to the biased valve and being disposed within the primary sub housing axial bore, whereby fluid flowing through the axial bore of the primary sub housing impinges upon the fluid-impinged surfaces and, at a sufficient fluid flow rate, generates motive force in and movement of the valve in opposition to its bias and into the open circulation position, thereby permitting the flow of the fluid out of the valve and the primary sub housing through the valve circulation ports and the primary sub housing circulation ports, and wherein the primary sub housing, the biased valve and the biasing means are formed to operate together so that the biasing of the biasing means is carried out without the application of motive force to the valve resulting from differences between fluid pressure within the apparatus and fluid pressure outside of the apparatus, and wherein during operation of the apparatus the fluid flows through a restricted flow path which is defined at least in part by the fluid-impinged surfaces and has a minimum cross-sectional area that remains unchanged while the valve is moved into and out of the open circulation position.

19. The apparatus of claim 18, further comprising:

an adapter operatively connected to the biased valve, wherein the fluid-impinged surfaces are formed by at least one turbine-like blade radially extending from, and either integral with or connected to, the adapter.

20. An apparatus for diverting fluid flow out of a working string, the apparatus comprising:

a primary sub housing defining a first axial bore therethrough, the primary sub housing having a primary sub housing sidewall with at least one primary sub housing circulation port;

a biased valve positioned within the first axial bore, the biased valve defining at least one biased valve circulation port and a second axial bore therethrough;

a biasing means having a biasing force sufficient to displace the biased valve to a closed circulation position; and at least one fluid-impinged surface integral with or connected to the biased valve, the fluid-impinged surface positioned within the first axial bore and outside the second axial bore;

wherein, when a fluid flows through the first axial bore and impinges upon the fluid-impinged surface at a sufficient flow rate, a motive force exceeding the biasing force is generated thereby displacing the biased valve to an open circulation position in which the primary sub housing circulation port is in fluid communication with the biased valve circulation port, and wherein the fluid flows through a substantially constant inlet cross-sectional area, the inlet cross-sectional area comprising the fluid-impinged surface and the primary sub housing sidewall.

21. The apparatus of claim 20 further comprising:

an adapter operatively connected to the biased valve, wherein the fluid-impinged surfaces are formed by at least one turbine-like blade radially extending from, and either integral with or connected to, the adapter.

* * * * *

UNITED STATES PATENT AND TRADEMARK OFFICE

CERTIFICATE OF CORRECTION

PATENT NO. : 9,145,748 B1
APPLICATION NO. : 14/527407
DATED : September 29, 2015
INVENTOR(S) : Kyle R. Meier and Christopher R. Arnold It is certified that error appears in the above-identified patent and that said Letters Patent is hereby corrected as shown below:

IN THE CLAIMS:

Claim 11, at column 10 line 12, reads “the tool” and should read -- the apparatus --.

Claim 11, at column 10 line 14, reads “the tool” and should read -- the apparatus --.

Claim 12, at column 10 line 42, reads “the circulating ports” and should read -- the circulation ports --.

Claim 12, at column 10 line 46, reads “tool” and should read -- downhole device --.

Claim 14, at column 10 line 64, reads “the tool” and should read -- the downhole device --.

Claim 14, at column 10 line 66, reads “the tool.” and should read -- the downhole device. --.

Claim 15, at column 11 line 7, reads “the tool.” and should read -- the downhole device. --.

Signed and Sealed this
Seventeenth Day of May, 2016

Michelle K. Lee

Michelle K. Lee
*Director of the United States Patent and Trademark Office*